US007379695B2

(12) United States Patent
Berkes et al.

(10) Patent No.: US 7,379,695 B2
(45) Date of Patent: May 27, 2008

(54) SYSTEM TO PREVENT PRINT HISTORY ON A FUSER ROLL

(75) Inventors: John S. Berkes, Fairport, NY (US); Gerald M. Fletcher, Pittsford, NY (US); Brendan Kunzmann, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 329 days.

(21) Appl. No.: 11/314,511

(22) Filed: Dec. 21, 2005

(65) Prior Publication Data

US 2007/0140755 A1 Jun. 21, 2007

(51) Int. Cl.
*G03G 15/20* (2006.01)

(52) U.S. Cl. ..... 399/327

(58) Field of Classification Search ..... 399/324–328
See application file for complete search history.

(56) References Cited

U.S. PATENT DOCUMENTS 5,802,440 A * 9/1998 Maeyama ..... 399/324
6,091,923 A * 7/2000 Yamamuro ..... 399/324

FOREIGN PATENT DOCUMENTS

JP 2005234001 A * 9/2005
JP 2005321624 A * 11/2005
JP 2005321625 A * 11/2005

* cited by examiner

*Primary Examiner*—Ryan Gleitz
(74) *Attorney, Agent, or Firm*—James J. Ralabate

(57) ABSTRACT

Provided herein is a system for using a cleaning web in an electrostatic printing process to provide a uniform and thin wax layer on the fuser roll and thereby minimize print history effects, reduce triboelectric voltages on the fuser roll and provide uniform and improved release of the toner from the fuser roll. The application of this beneficial thin film to the fuser roll is accomplished by impregnating the cleaning web with a wax material that is substantially the same as the wax material in the toner used in the system. This impregnated wax, therefore, has the same release and triboelectric properties as the wax in the toner and therefore will not attract residual toner but will rather repel it.

9 Claims, 3 Drawing Sheets

SYSTEM TO PREVENT PRINT HISTORY ON A FUSER ROLL

CROSS REFERENCES

Illustrated and disclosed in co-pending application I.D. 20051173, owned by the present assignee is a system for controlling fuser roll voltage and polarity and thereby preventing toner build up on a fuser roll in a printing system by the use of charge control agents. This application I.D. 20051173 and the present application are filed concurrently herewith. The disclosure of I.D. 20051173 is totally incorporated herein by reference.

FIELD

This invention relates generally to image forming machines and methods, more specifically to the fusing system used in electrostatic systems.

BACKGROUND

Electrophotographic image-forming machines are used to transfer images onto paper or other medium in both printing and copier systems. Generally, a photoconductor is selectively charged and optically exposed to form an electrostatic latent image on the photoconductor surface. Toner is deposited onto the charged photoconductor surface. The toner has a charge; thus, it will adhere to the photoconductor surface in areas corresponding to the electrostatic latent image. The toner image is transferred to the paper or other medium. The toned paper is heated by any of several methods including a fuser roller system and the toner in image-wise configuration is fused to the paper. The photoconductor is then refreshed—cleaned to remove any residual toner and charge—to make it ready for another image. The imaged paper is then passed to a document output collection area or tray where the user collects the finished, permanently imaged paper or documents.

The fuser roll used in the fuser roller system eventually becomes contaminated with a film or debris containing toner or by-products of toner and paper. This contamination usually takes the form of a film which eventually builds up and adversely affects the performance and life of the fuser roll.

This fuser roll contamination can generally occur in any fuser system of an electrophotographic printer or copier, and it causes marks on copy (MOC) in addition to marks caused by prior image history. Generally, the fuser roll becomes contaminated, as earlier noted, with toner and by-products of fuser chemical reactions which eventually can cause early failure of the entire fusing system. There is no known convenient, practical solution to this fuser roll contamination due to competing effects of control factors.

Problems with toner debris on the fuser roller can eventually affect the pressure roll and also the quality and clarity of the imaged paper in contact with the fuser roller. As noted above, the life of the relatively expensive fuser roll can be substantially shortened if this contamination problem is not properly addressed.

SUMMARY

In a high speed and other printer fuser system, the fuser roll is usually contacted by a cleaning web which has as its primary object the continuous cleaning of the fuser roll.

This web in many machines is made from NOMEX® (a trademark of DuPont Corporation). In some instances, the contamination of the fuser roll is eventually transferred to the cleaning web and could lessen its intended cleaning purpose or effectiveness. The fuser rolls are typically made from an aluminum base coated with Teflon® or VITON®, (trademarks of DuPont Corporation).

The fusing system in an embodiment comprises in operative relationship a toned paper transport, a fuser roll, a cleaning web and a pressure roll. The fuser roll is in operative contact with the pressure rolls and paper during the fusing step.

All fusers have non-visible offset (NVO) to some level which can be higher for toners which transfer easily. NVO is toner residual that remains on the fuser roll after the fusing event. Fuser rolls which have poor conformance may not transfer the NVO back to the paper and the NVO has to be cleaned. Cleaning the NVO with a web results in an accumulation of toner in the web resulting in marks on copy (MOC) due to stop-start usage. The mechanism for MOC formation goes as follows. The removal of NVO from the fuser roll by the cleaning web results in a substantial amount of toner debris in the web. In between printing jobs, the fuser roll stops rotating. During the restart the presence of a low melting wax layer on the fuser roll provides a weak boundary layer and enables the web to retain-the toner. In the absence of an adequate wax layer a restart can split the toner layer on the web within the toner layer. If this happens, some of the toner will remain with the web and some of the toner will adhere to the fuser roll and be transferred to the pressure roll. Transfer of toner to the pressure roll occurs by layer splitting and ultimately the back side of the first few prints will have "blobs" of toner on the back of the page which are known as Marks On Copy (MOC). Prints made with toners which use an internal wax as a release agent, leave a non-uniform wax/release layer on the fuser roll. The MOC level is dependent on print history which is due to the image wise and non-uniform residual wax left on the fuser roll. MOC will be low in high image coverage areas and high in low image coverage regions, but may also be partly due to wear or other factors.

An embodiment herein provides a means to reduce both the NVO and the back-transfer of cleaned toner from a fuser's cleaning web to the fuser roll (FR) which produces a Marks-On-Copy (MOC) defect especially common with Teflon-based fusers and wax containing toners. As noted, MOC is a strong function of prior image history, with low area coverage producing much worse MOC, whether due to the loss of a sacrificial wax layer at the toner/fuser roll (FR) interface or due to the higher tribo-electric induced steady-state FR voltage reached by a "wax-free" FR. By impregnating the cleaning web with a wax like that in the toner, it has been demonstrated that the toner release is improved and the voltage levels on the FR are reduced by ~70% equivalent to a non-stress image history, and that MOC is substantially reduced. This continual application of a wax layer on the FR surface therefore eliminates the severe image history-dependent noise in MOC. Testing in a full machine showed removal of image-history defect and reductions in MOC.

To minimize MOC, it is important to provide a uniform and relatively constant wax level on the fuser roll, irrespective of print history. A suitable wax level on the fuser roll will eliminate or at least substantially reduce history effects for MOC. As noted, in a present embodiment a suitable solution to toner build up on the fuser roll is provided independent of print history. This is accomplished by impregnating the fuser cleaning web with wax which when in contact with the fuser roll, melts and produces a thin uniform wax layer. The continual application of a wax layer onto the fuser roll will ensure sufficient and moderately uniform wax level on the fuser roll and thereby maintain very good toner release and modest triboelectric induced voltages on the fuser roll.

Toner always has a charge (generally negative in most machines) so that it will be attracted to a latent positive image prior to fusing of the toner to the paper. If the wax impregnated on the cleaning web and transferred from the web to the fuser roll also has the same or similar charge as the toner, it will repel rather than attract the toner. For example, if the wax (or polymer) used in the toner is a polyethylene wax, then this same polyethylene can be used as the wax coating on the fuser roll. When the term "same" or "like" or "similar" is used in the specification and claims, it means a toner material and a wax coating that have similar melting points and triboelectric properties so that there is no chemical incompatibility or toner attraction to the coated fuser roll. It is easiest and more convenient to use the same materials in the toner and fuser roll wax coating, i.e., polyethylene containing toner—polyethylene wax coating; i.e. polystyrene containing toner—polystyrene wax coating; i.e. polyethylene containing toner—polyethylene wax coating; N-Butyl methacrylate toner—N-Butyl methacrylate wax coating; polystyrene N-Butyl methacrylate toner—polystyrene N-Butyl methacrylate wax coating on the fuser roll. As earlier noted, an important criteria is that the fuser roll coating (wax) have substantially the same properties as the polymer or wax in the toner being used. Similar melting points and molecular weights improve effectiveness of the cleaning process.

The Teflon® (PFA) coating on the fuser roll is a dielectric which can be charged by friction when the fuser roll rubs against the pressure roll and paper. After it takes on this charge, it is generally of a polarity that will attract and retain toner particles. The solution provided herein in an embodiment is to minimize the tribo-electric charge and keep it uniform by applying a wax coating having a polarity similar to that of the toner. Ideally, the wax should produce a near neutral surface charge but small deviations in fuser roll surface voltage are acceptable. Since the web cleaner is constantly in contact with the fuser roll, it becomes the most convenient applicator of this fuser roll coating. The web can be impregnated with wax by any suitable method, including spraying, surface treatment, dip coating, internal or surface impregnation, liquid application, solvent coating, powder application, etc.

After the impregnated cleaning web is totally unwound, it is discarded from the system and replaced with a new wax impregnated web. The amount of wax impregnation can be any suitable amount including about 0.0001 to 0.1 gm wax per 1 square cm. of web.

In summary, one embodiment provides an electrophotographic marking system that comprises at least toned paper transport, one charge, expose and development station. The development station comprises in an operative relationship a toner supplier, at least one roller cleaning web and at least one fuser roll. The cleaning web is enabled to clean a surface of the fuser roll, the cleaning web being treated to form an impregnated web comprising a wax substance that is substantially the same in chemical composition to a wax material in the toner. The impregnated web when in contact with the fuser roll is enabled to form a wax film and at least reduce print history effects on the fuser roll due to image-wise residual toner wax or lack thereof on the fuser roll. In this marking system, the cleaning web is in operative cleaning contact with the fuser roll and the web is impregnated with wax, which is enabled when in contact with the fuser roll as noted to form a substantially uniform wax layer on the fuser roll.

In an embodiment, this marking system uses a web with a film or particulate wax that comprises a wax having similar properties as a wax in the toner.

DETAILED DESCRIPTION OF DRAWINGS AND PREFERRED EMBODIMENTS

Figure 1:
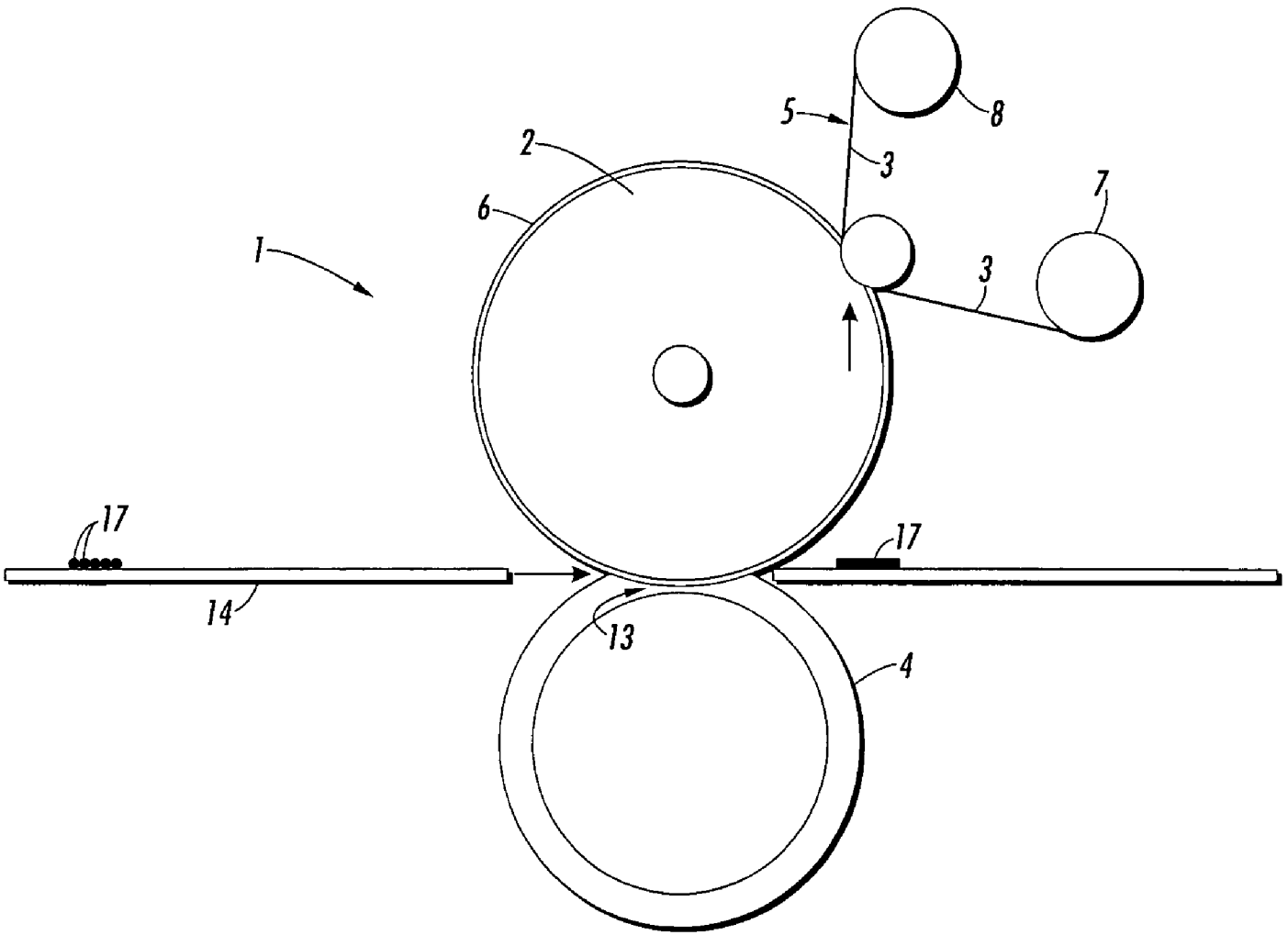
FIG. 1 illustrates an embodiment having an impregnated cleaner web and a wax coated fuser roll.

In FIG. 1, a schematic is illustrated showing a fusing system having a toned paper transport 14, a fuser roll 2, a cleaning web 3 and a pressure roll 4. Cleaning web 3 is continuously in contact with fuser roll 2 whereby the wax impregnated portion 5 of cleaning web 3 will transfer the wax 5 in a continuous manner to the surface of fuser roll 2 to form a wax film or coating 6 on fuser roll 2. The wax film 6 will contain a major portion of a substance having the same properties as the wax 17 in the toner being used in the system 1. The surface of fuser roll 2 is generally coated with a Teflon® coating; marks on copy (MOC) are especially common with Teflon-based fuser rolls 2 and toners that transfer easily. By impregnating the cleaning web 3 with a wax like that in the toner 17, it has been demonstrated that toner release and print history effects due to the voltage variation on the fuser roll 2 are reduced in one embodiment by greater than 70%, which is equivalent to a non-stress image history, and the MOC is significantly reduced. As earlier noted, when plain paper is continuously passed between nip 13, the fuser roll takes on a charge of about 100 volts which is reduced to about 30 volts by the wax coating 6 applied by web 3. By "relatively low tribo voltage" is meant throughout the disclosure and claims—a voltage suitable to substantially reduce voltage of uncoated prior art fuser rolls, and to provide a fuser roll that minimizes print history effects; and improves toner 17 release.

Figure 2:
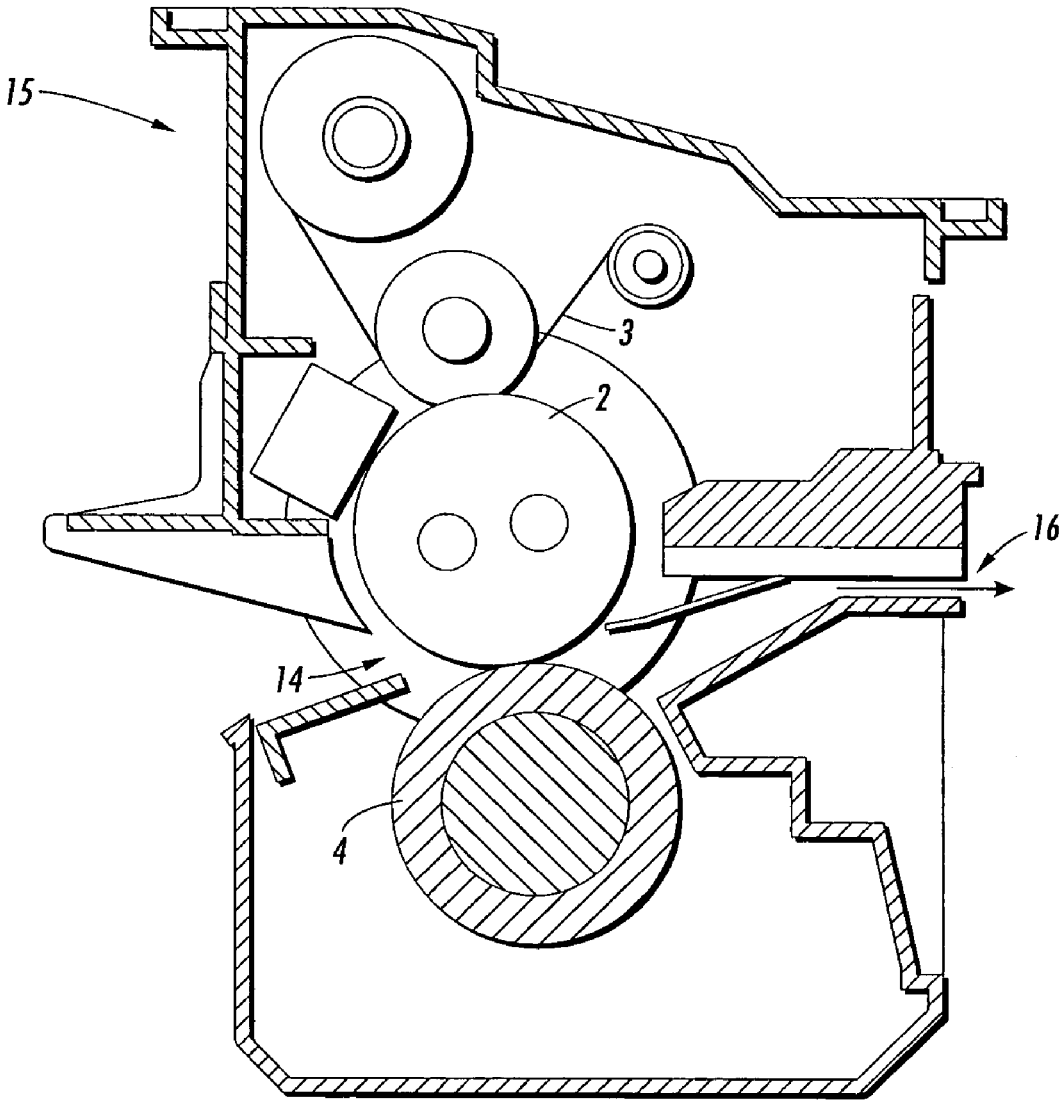
FIG. 2 illustrates a typical complete electrostatic fuser system that can use the fusing components of the present invention.

In FIG. 2 an electrophotographic fusing apparatus 15 is illustrated which can use an embodiment of the fusing system 1 disclosed herein and illustrated in FIG. 1. A wax impregnated cleaning web 3 is shown in constant contact with the fuser roll 2, thereby enabled to deposit a uniform wax film 6 on the fuser roll; (see FIG. 1). A paper feed 14 is shown, which is adapted to feed a toned paper between the fuser roll 2 and the pressure roll 4 and transport the fused toner paper to paper out exit 16.

Figure 3:
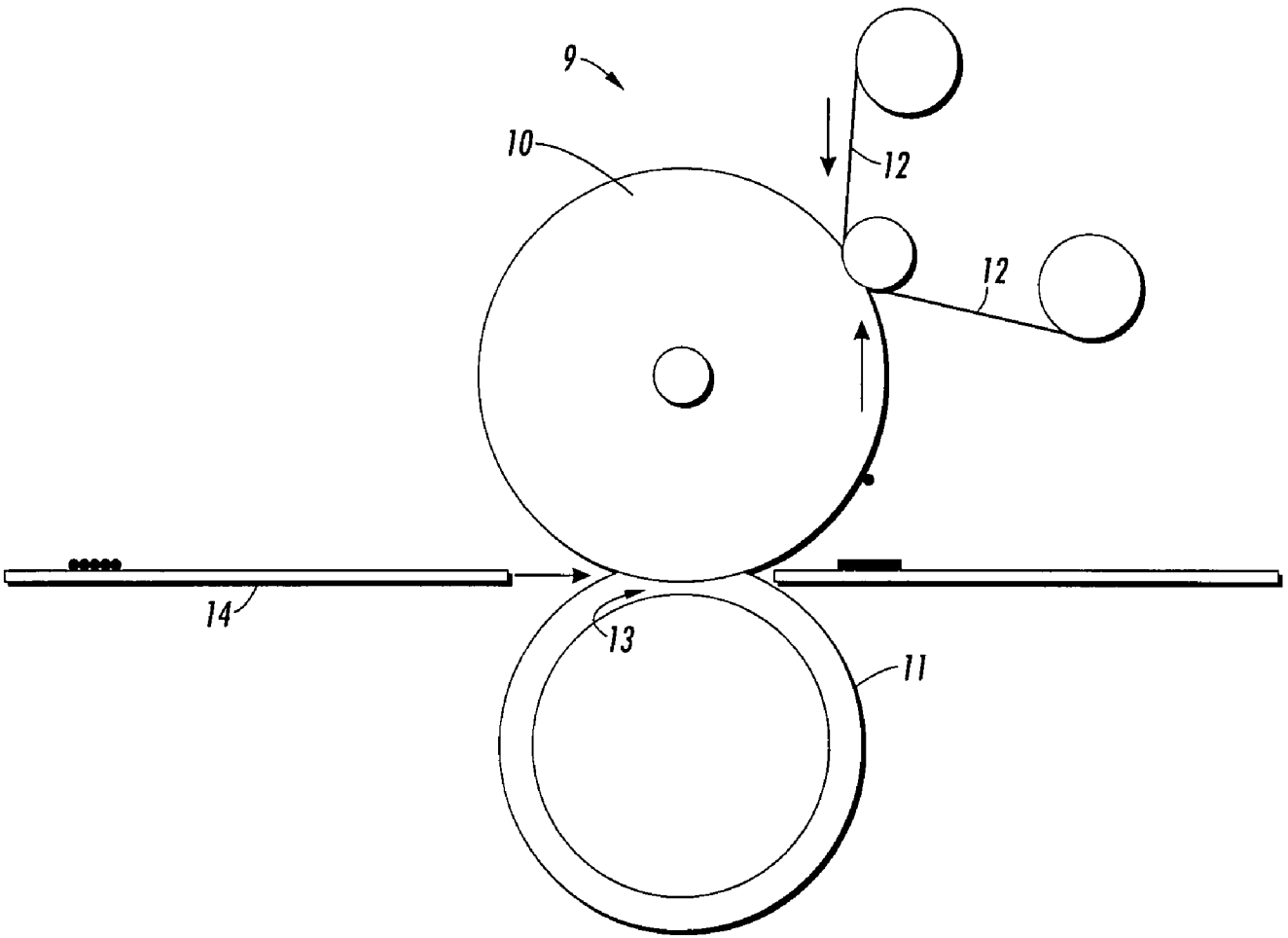
FIG. 3 (PRIOR ART)
FIG. 3 illustrates a prior art similar system using a fuser roll, a cleaner web and a pressure roll and toned paper transport.

In FIG. 3 where a typical prior art system 9 is illustrated, fuser roll 10 is not coated nor is web 12 wax impregnated which generally results in a substantial variation in the fuser roll wax film and consequent triboelectric voltage with substantial magnitude and variation which is due to print history. In an embodiment of FIG. 1 of this invention, the cleaning web 3 is used to apply a uniform layer 6 of release wax onto the fuser roll 2 and thereby improve toner release and reduce fuser roll tribo induced voltage and substantially minimize fusing history effects. These print history effects produce spatial and print number dependent surface voltage variation which impact toner release and ultimately results in MOC. While a substantial MOC reduction is seen in testing, another advantage of this embodiment (FIG. 1) is to reduce NVO and improve toner release in the cleaning nip.

In an embodiment, an electrostatic printing system is provided comprising in an operative arrangement a toned paper feed station, at least one roller cleaning web, at least one fuser roll and at least one pressure roll. The cleaning web is enabled to continually contact the fuser roll. The toned paper comprises a toner including a wax material selected from the group consisting of polyethylene, polystyrene, N-Butyl methacrylate and mixtures thereof. The cleaning web has impregnated therein a wax composition. The cleaning web is enabled to transfer the wax composition to the fuser roll to form a thin and substantially uniform wax layer on the outer surface of the fuser roll. The uniform wax layer is adapted to maintain uniform toner release, which can vary due to fuser history and maintain a relatively low triboelectric voltage on the fuser roll. As earlier noted, the wax composition used comprises a material selected from the group consisting of polyethylene, polystyrene, N-Butyl methacrylate and mixtures thereof. The wax material in the toner has substantially the same properties as the wax in the web, and the wax material in the toner has substantially the same properties as in the uniform wax layer.

The cleaning web is in continual operative cleaning contact with the fuser roll during a feeding of at least one toned paper sheet as it is fed into the system. It is also possible to achieve the desired effect if the web is in contact with the fuser roll only when the fuser roll is rotating.

In an embodiment, this marking or printing system comprises typical charge, expose and development stations. The development station comprises, in operative relationship, a toner supplier, a toned paper conveyance, at least one cleaning web and at least one fuser roll. The cleaning web is enabled to clean the surface of the fuser roll. This cleaning web is impregnated with a wax substance similar in chemical composition and other properties to a material in the toner. This wax impregnation on the cleaning web results in a cleaning web with a wax coating that may be either a continuous film or a uniform distribution of micron size wax particles. Tribo voltage in prior art uncoated fuser rolls is substantially high (about +100V) which is so high that it attracts negative toners which produces NVO and ultimately MOC. In one embodiment of the present system, the observed tribo voltage on a coated fuser roll is about +30V, which is low enough to provide a substantial improvement over the prior art. This constant wax coating is highly desirable since it assures a constant and relatively low tribo voltage on the fuser roll. The web, when in contact with the fuser roll, forms a wax coating on the fuser roll which is enabled to at least reduce print history effects on the fuser roll due to image-wise residual toner wax. The wax in the impregnated web has substantially the same or similar melting point as the principal wax in the toner.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system comprising charge, expose, and development stations, said development station comprising in an operative relationship a toner supplier, at least one roller cleaning web and at least one fuser roll, said cleaning web enabled to clean surface of said fuser roll, said cleaning web being treated to form an impregnated web comprising a wax substance similar in chemical composition and triboelectric properties to a material in said toner, said impregnated web when in contact with said fuser roll forming on said cleaning web a member selected from the group consisting of uniform distribution of micron sized wax particles, and a wax coating on said fuser roll which is enabled to at least reduce print history effects on said fuser roll due to image-wise residual toner wax, and wherein both said wax composition and said toner have a charge of the same polarity and wherein said wax composition is adapted to maintain uniform toner release and a relatively low tribo voltage on said fuser roll.

2. The marking system of claim 1 wherein said cleaning web is in continual operative cleaning contact with said fuser roll.

3. The marking system of claim 1 wherein said cleaning web is impregnated with wax, which is enabled when in contact with said fuser roll, to continuously form on said cleaning web member selected from the group consisting of uniform distribution of micron sized wax particles and a substantially uniform wax layer on the surface of said fuser roll.

4. The marking system of claim 1 wherein the wax is applied to the cleaning web by a convenient means, such as solution coating, melt coating, spray coating, particulate dusting, and mixtures thereof thereby providing a cleaning web with a wax coating that may be either a continuous film or a uniform distribution of micron-size wax particles.

5. The marking system of claim 1 wherein said wax coating has at least some of the same properties as a wax in said toner, thereby enabling said wax coating to provide a constant and relatively low tribo voltage on the fuser roll.

6. The marking system of claim 1 wherein said cleaning web is enabled to transfer a uniform distribution of said wax particles to said fuser roll which is enabled to reduce NVO and improve toner release in a cleaning nip between said pressure roll and said fuser roll.

7. The marking system of claim 1 wherein said wax composition is selected from the group consisting of polyethylene, polypropylene, polystyrene, N-Butyl methacrylate, styrene acrylates and mixtures thereof.

8. The marking system of claim 1 wherein said wax composition and said toner comprise polyethylene.

9. The marking system of claim 1 wherein said wax composition on said fuser roll is a wax coating or film comprising polyethylene wherein said coating provides a relatively low tribo voltage on said fuser roil.

* * * * *